US007410156B2

(12) United States Patent
Ikeda et al.

(10) Patent No.: US 7,410,156 B2
(45) Date of Patent: Aug. 12, 2008

(54) SHEET PROCESSING APPARATUS AND IMAGE FORMING APPARATUS EQUIPPED WITH THE SAME

(75) Inventors: Taro Ikeda, Tokyo (JP); Hiroaki Takagishi, Tokyo (JP); Kenichi Hayashi, Abiko (JP); Tomokazu Nakamura, Matsudo (JP); Wataru Kawata, Kashiwa (JP); Hideki Kushida, Moriya (JP); Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/688,266

(22) Filed: Mar. 20, 2007

(65) Prior Publication Data

US 2007/0161489 A1 Jul. 12, 2007

Related U.S. Application Data

(62) Division of application No. 11/180,540, filed on Jul. 14, 2005.

(30) Foreign Application Priority Data

Jul. 20, 2004 (JP) ..... 2004-211806
Jun. 30, 2005 (JP) ..... 2005-193037

(51) Int. Cl.
*B65H 37/04* (2006.01)

(52) U.S. Cl. ..... 270/37; 270/58.07; 270/58.08; 270/58.09; 270/58.11; 270/58.12

(58) Field of Classification Search ..... 270/37, 270/58.07, 58.08, 58.09, 58.11, 58.12
See application file for complete search history.

(56) References Cited

U.S. PATENT DOCUMENTS

| | | | | |
|---|---|---|---|---|
| RE33,847 | E | 3/1992 | Diblasio | 271/3.2 |
| 5,897,250 | A | 4/1999 | Hirai et al. | 399/404 |
| 6,042,099 | A | 3/2000 | Takagishi | 271/2 |
| 6,145,826 | A | 11/2000 | Kawata | 270/58.28 |
| 6,219,503 | B1 | 4/2001 | Miyake et al. | 399/85 |
| 6,237,910 | B1 | 5/2001 | Kawata | 271/213 |

(Continued)

FOREIGN PATENT DOCUMENTS

JP 2000-153947 6/2000

(Continued)

*Primary Examiner*—Gene O. Crawford
*Assistant Examiner*—Leslie A Nicholson, III
(74) *Attorney, Agent, or Firm*—Fitzpatrick, Cella, Harper & Scinto

(57) ABSTRACT

A sheet processing apparatus includes a processing tray on which sheets are stacked in a bundle form, an intermediate portion stapler which staples the intermediate portion of the sheet bundle stacked on the processing tray, a sheet bundle conveying member which conveys the stapled sheet bundle, a curved sheet bundle conveying path which is downwardly curved on the downstream side of the processing tray with respect to the sheet conveying direction and adapted to guide the sheet bundle conveyed by the sheet bundle conveying member, and a folding device which is arranged in the intermediate portion of the curved sheet bundle conveying path and which folds the stapled sheet bundle, wherein the processing tray is set to be lower on the upstream side than on the downstream side with respect to the sheet conveying direction, and wherein the curved guide path has an extended portion extending to a position under the stacking portion.

13 Claims, 9 Drawing Sheets

U.S. PATENT DOCUMENTS

| | | | | |
|---|---|---|---|---|
| 6,251,054 | B1 | 6/2001 | Cruz et al. | 493/383 |
| 6,264,189 | B1 | 7/2001 | Kawata | 271/176 |
| 6,264,194 | B1 | 7/2001 | Hayashi et al. | 271/220 |
| 6,276,677 | B1 | 8/2001 | Hommochi et al. | 270/32 |
| 6,290,220 | B1 | 9/2001 | Takehara et al. | 270/58.12 |
| 6,427,997 | B1 * | 8/2002 | Hirota et al. | 270/58.12 |
| 6,505,829 | B2 | 1/2003 | Kawata | 271/208 |
| 6,526,256 | B2 | 2/2003 | Yoshie et al. | 399/407 |
| 6,578,838 | B2 | 6/2003 | Trovinger et al. | 270/52.18 |
| 6,647,243 | B2 | 11/2003 | Sato et al. | 399/407 |
| 6,804,473 | B2 | 10/2004 | Nakamura et al. | 399/16 |
| 6,908,078 | B2 | 6/2005 | Suzuki et al. | 270/15 |
| 6,957,810 | B2 | 10/2005 | Yamada et al. | 270/58.08 |
| 6,976,672 | B2 | 12/2005 | Kawata | 271/9.11 |
| 7,011,306 | B2 | 3/2006 | Kato et al. | 271/256 |
| 7,050,752 | B2 | 5/2006 | Sato et al. | 399/405 |
| 7,107,006 | B1 | 9/2006 | Sato et al. | 399/407 |
| 7,128,118 | B2 | 10/2006 | Kramer et al. | 156/542 |
| 2003/0219294 | A1 * | 11/2003 | Yoshimura et al. | 399/408 |
| 2004/0096254 | A1 | 5/2004 | Sato et al. | 399/405 |
| 2005/0082734 | A1 | 4/2005 | Goto et al. | 271/1 |
| 2005/0082735 | A1 | 4/2005 | Nakamura et al. | 271/1 |
| 2005/0084308 | A1 | 4/2005 | Nakamura et al. | 399/407 |
| 2005/0179190 | A1 | 8/2005 | Kamiya et al. | 270/58.07 |
| 2006/0017209 | A1 | 1/2006 | Kushida et al. | 270/37 |
| 2006/0017218 | A1 | 1/2006 | Kawata et al. | 271/207 |
| 2006/0018694 | A1 | 1/2006 | Hayashi | 399/406 |
| 2006/0019811 | A1 | 1/2006 | Ikeda et al. | 493/444 |
| 2006/0061031 | A1 | 3/2006 | Kawata | 271/9.11 |

FOREIGN PATENT DOCUMENTS

| | | |
|---|---|---|
| JP | 2003-261261 | 9/2003 |

* cited by examiner

SHEET PROCESSING APPARATUS AND IMAGE FORMING APPARATUS EQUIPPED WITH THE SAME

This application is a divisional of U.S. patent application Ser. No. 11/180,540, filed Jul 14, 2005.

BACKGROUND OF THE INVENTION

1. Field of the Invention

The present invention relates to a sheet processing apparatus for performing processing on sheets and to an image forming apparatus equipped with this sheet processing apparatus. In particular, the present invention relates to a sheet processing apparatus which is endowed with a staple processing function for stapling an intermediate portion of a sheet bundle and which realizes a reduction in size through dimensional reduction in the height direction and the horizontal direction.

2. Related Background Art

Conventionally, there exists, for example, a sheet processing apparatus which staples sheets in the form of a bundle. This sheet processing apparatus is capable of a processing (so-called saddle stitching) in which sheets in the form of a bundle are stapled at the intermediate portion thereof and folded into a booklet. Such a sheet processing apparatus may be provided in the apparatus main body of an image forming apparatus as a component of the image forming apparatus (See JP 2000-153947 A).

FIG. 6 shows such an image forming apparatus. A conventional sheet processing apparatus 901 shown in FIG. 6 can perform saddle stitching as mentioned above, alignment processing for aligning an end portion of a sheet bundle (so-called sorting), side stitch binding for stapling an end portion of a sheet bundle (so-called staple sorting), etc.

That is, in the conventional sheet processing apparatus 901, sheets successively received from an apparatus main body 903 of an image forming apparatus 902 are stacked on a saddle stitching tray 910 formed as a substantially straight, steep slope, and are received by a stopper 911 to be formed into a bundle. Then, the sheet processing apparatus 901 performs width alignment on the sheets P by a width alignment device (not shown) before stapling the sheet bundle at two positions near the center thereof by an intermediate portion stapler unit 912. Thereafter, the sheet processing apparatus 901 moves the stopper 911, and causes the stapled portion of the sheet bundle to face the nip of a sheet folding roller pair 914 and a sheet thrusting plate 913. Then, the sheet processing apparatus 901 thrusts the stapled portion of the sheet bundle with the sheet thrusting plate 913, and feeds the sheet bundle to the nip of the sheet folding roller pair 914, folding the sheet bundle into two while nipping and conveying it by the sheet folding roller pair 914. Finally, the sheet processing apparatus 901 discharges the sheet bundle onto a sheet stacking portion 905 by a sheet discharging roller pair 915. In this way, the conventional sheet processing apparatus 901 shown in FIG. 6 is capable of performing saddle stitching to form a sheet bundle into a booklet by folding it into two.

Further, the conventional sheet processing apparatus 901 successively receives, on an intermediate tray 906, sheets P with images formed on one or both sides thereof in the apparatus main body 903 of the image forming apparatus 902, and, while doing so, performs width alignment on the sheets by a width alignment device 907 to form them into a bundle. Thereafter, the sheet processing apparatus 901 staples an end portion of the sheet bundle by an end stapler unit 908, and discharges the sheet bundle onto a sheet stacking portion 904 by a sheet discharging roller pair 909. In this way, the conventional sheet processing apparatus 901 shown in FIG. 6 is also capable of performing staple sorting.

FIG. 7 shows an image forming apparatus constructed so as to achieve a reduction in footprint. An image forming apparatus 921 has an image forming portion 922 in the lower portion thereof, an automatic original feeding apparatus 923 and an original reading device 924 in the upper portion thereof, and a sheet processing apparatus 925 in a sheet discharging space AR between the image forming portion 922 and the original reading device 924; thus, the image forming apparatus has a vertically elongated configuration to thereby achieve a reduction in footprint. As shown in FIGS. 7 through 9, the sheet processing apparatus 925 provided in the image forming apparatus 921 temporarily stacks sheets P with images thereon discharged from the image forming portion 922 on a processing tray 960 to form them into a bundle, and performs processing such as aligning and stapling on the sheet bundle before stacking the processed sheet bundle P on a discharge tray 961.

That is, in FIG. 8, the sheets P discharged from the image forming portion 922 (See FIG. 7) are further discharged onto the processing tray 960 from a discharging roller pair 941*a*, 941*b*. Then, the sheets P are brought into contact with a trailing end stopper 943 through inclination of the processing tray 960 and rotation of a return belt 942, and the end portions extending perpendicular to the conveying direction are aligned. Further, alignment (width direction alignment) is effected on side portions extending along the sheet conveying direction by means of an aligning plate 944. In this way, the sheets successively discharged onto the processing tray 960 undergo alignment of the trailing ends and side portions to be formed into a bundle, and then an end portion of which is stapled by an end stapler 962.

The sheet bundle thus stapled is pressed against a swinging roller 948 mounted to a swinging arm 949 swingable in the direction indicated by the arrow A and in a direction opposite thereto, and is conveyed in the direction indicated by the arrow B through rotation of the swinging roller 948. Finally, the sheet bundle is discharged onto a discharge tray 961. When the sheet bundle is discharged onto the discharge tray 961, the swinging arm 949 returns to the position indicated by a chain double-dashed line in the drawing to make itself ready for next processing. When no stapling is effected in the above-described processing, the sheets, not stapled together, are discharged one by one onto the discharge tray 961 and stacked thereon.

In the sheet processing apparatus 901 shown in FIG. 6, capable of performing the above-described saddle stitching, the saddle stitching tray 910 accommodating sheets is linear, and the sheet thrusting plate 913, the sheet folding roller pair 914, and the stopper 911 are arranged linearly along the same, so that the length of the apparatus in the sheet conveying direction is rather large, which means the size of the apparatus tends to be rather large. Thus, it cannot be arranged in a space as shown in FIG. 7.

On the other hand, the sheet processing apparatus 925 shown in FIG. 7, which is arranged in the above-mentioned space, is not capable of performing saddle stitching.

SUMMARY OF THE INVENTION

It is an object of the present invention to provide a sheet processing apparatus which can perform stapling to staple an intermediate portion of a sheet bundle and which can achieve a reduction in size through restraining dimensional increase in the height direction and the horizontal direction with respect to the sheet conveying direction, thus allowing installation, for example, between the image forming means and the image reading means of an image forming apparatus.

It is another object of the present invention to provide an image forming apparatus equipped with a sheet processing apparatus which can perform stapling to staple an intermediate portion of a sheet bundle and which can achieve a reduction in size through restraining dimensional increase in the height direction and the horizontal direction with respect to the sheet conveying direction, making it possible to achieve an improvement in terms of sheet processing function without involving an increase in footprint.

To achieve the above objects, according to the present invention, there is provided a sheet processing apparatus including: a stacking portion on which sheets are stacked; a conveying portion which conveys a sheet or a sheet bundle stacked on the stacking portion; a curved guide path which is arranged on the downstream side of the stacking portion with respect to the sheet conveying direction and which guides the sheet or the sheet bundle conveyed by the conveying portion with downward curving; and a folding device which is arranged in the curved guide path and which folds the sheet or the sheet bundle, in which a sheet stacking surface of the stacking portion is set to be lower on the upstream side than on the downstream side with respect to the sheet conveying direction, and the curved guide path has an extended portion extending to a position under the stacking portion.

Further, to achieve the above objects, according to the present invention, there is provided, an image forming apparatus including an image forming means for forming an image on a sheet, and a sheet processing apparatus for performing processing on a sheet with an image formed thereon by the image forming means, in which the sheet processing apparatus is the sheet processing apparatus as described above.

In the sheet processing apparatus of the present invention, a sheet bundle stacked on a stacking portion whose sheet stacking surface is set to be lower on the upstream side than on the downstream side with respect to the sheet conveying direction, is folded by a folding device in a curved guide path downwardly curved on the downstream side of the stacking means with respect to the sheet conveying direction, which means the folding device is arranged below the stacking portion, so that, as compared with the conventional art, while endowed with a saddle stitch binding function, it is possible to achieve a reduction in the dimension in the height direction of the apparatus and a reduction in the horizontal dimension of the apparatus in the sheet conveying direction. Further, due to the fact that the sheet stacking surface of the stacking means is set to be lower on the upstream side than on the downstream side with respect to the sheet conveying direction, the stacking portion is inclined compared to the horizontal position, whereby the length of the stacking surface in the sheet conveying direction is much larger, making it possible to achieve a reduction in the horizontal dimension of the apparatus with respect to the sheet conveying direction. Further, there is provided, on the downstream side of the curved guide path with respect to the sheet conveying direction, an extended portion extending to a position under the stacking portion, so that it is also possible for the apparatus to be applied to a large format sheet without involving an increase in the horizontal dimension in the sheet conveying direction.

The image forming apparatus of the present invention is equipped with a small sheet processing apparatus which is short in the height direction and in the horizontal direction, so that, when the sheet processing apparatus is provided on the image forming apparatus, it is possible to enhance the sheet processing function without involving an increase in footprint.

DESCRIPTION OF THE PREFERRED EMBODIMENTS

Figure 1:
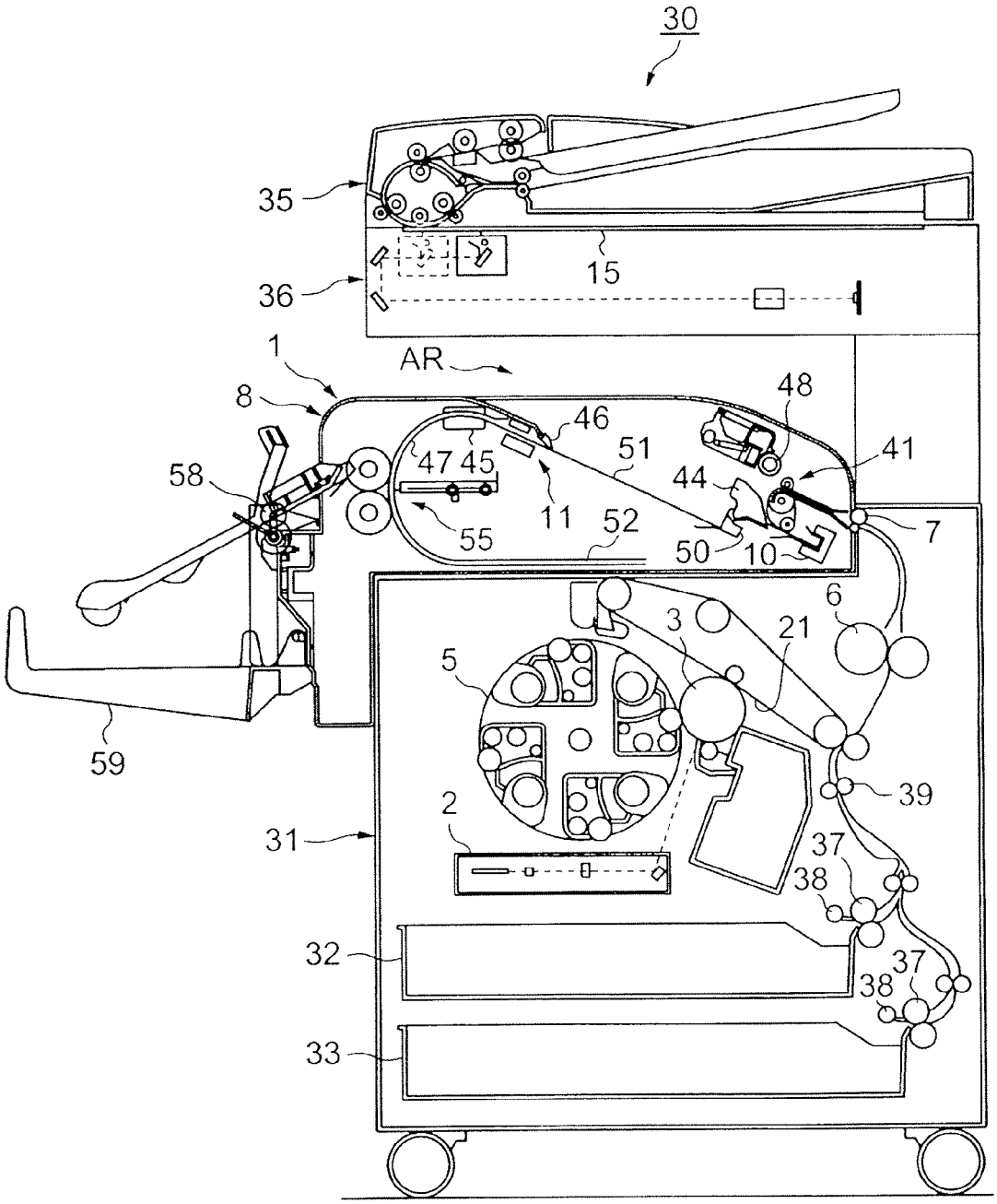
FIG. 1 is a schematic front sectional view of a color copying machine constituting an image forming apparatus according to an embodiment of the present invention.

In the following, an image forming apparatus and a sheet processing apparatus according to an embodiment of the present invention will be described with reference to the drawings.

(Image Forming Apparatus)

A color copying machine as an image forming apparatus will be described with reference to FIG. 1. Examples of the image forming apparatus include a copying machine, a printing apparatus, a laser beam printer, and a composite apparatus thereof. The image forming apparatus of this embodiment of the present invention is a multi-color copying machine, which should not be construed restrictively.

Mentioned sequentially from below, a color copying machine 30 has an apparatus main body 31, a sheet processing apparatus 1, an image reading device 36, and an original supply apparatus 35. The original supply apparatus 35 supplies originals automatically to the image reading device 36. The image reading device 36 as the reading means reads an original supplied by the original supply apparatus 35, or an original placed on an original plate 15 by the user by opening the image reading device 36 rearwards. It is not always necessary to provide the image reading device 36. Further, if the image reading device 36 is provided, it is not always necessary to provide the original supply apparatus 35. Further, in the color copying machine 30, sheets are discharged into a discharge space AR between the apparatus main body 31 and the image reading device 36, which means the color copying machine is of a so-called in-body discharge type. In this embodiment, the sheet processing apparatus 1 is detachably provided in the discharge space AR. When no image reading device 36 is provided, the sheet processing apparatus 1 is provided in the upper portion of the apparatus main body 31.

In either case, the attachment of the sheet processing apparatus does not involve an increase in the footprint of the apparatus main body 31, which means the footprint of the color copying machine 30 as a whole remains the same.

The operation of the color copying machine will be described. The original supply apparatus 35 supplies an original automatically to a reading position of the image reading device 36. The image reading device 36 reads an image of the original. A controller (not shown) supplies a signal to a laser scanner unit 2 based on the image information read by the image reading device 36. The laser scanner unit 2 applies a laser beam to a photosensitive drum 3 which constitutes an image forming portion and whose surface is uniformly charged. The image information signal received by the laser scanner unit 2 may also be an image information signal supplied from an external personal computer or the like. Further, even when no image reading device 36 is provided, the laser scanner unit 2 applies a laser beam to the photosensitive drum 3 based on an image signal supplied from outside.

An electrostatic latent image on the photosensitive drum 3 is developed with toner by a developing device 5 to be turned into a toner image. The toner image is transferred to a transferring belt 21, and then transferred to a sheet P such as a paper sheet or an OHP sheet.

The sheets P are selectively fed out as appropriate from sheet cassettes 32 and 33 by pick-up rollers 38, and one sheet is separated from the sheet stuck by a separation roller pair 37 to be fed one by one to a registration roller pair 39. Then, after being corrected by the registration roller pair 39 in terms of skew feeding, each sheet P is sent to a transfer position in synchronism with the rotating of the photosensitive drum 3 and the transferring belt 21. As a result, the toner image on the transferring belt 21 is transferred to the sheet P.

Thereafter, the sheet P is guided to a fixing roller pair 6, where it is heated and pressurized, whereby the toner image is permanently fixed to the sheet P. The rollers of the fixing roller pair 6 are respectively in contact with an upper fixing/separation claw and a lower fixing/separation claw, and the sheet P is separated from the fixing roller pair 6 by these claws. The separated sheet P is sent from the apparatus main body 31 of the color copying machine to the sheet processing apparatus 1 by a discharging roller pair 7.

(Sheet Processing Apparatus)

The sheet processing apparatus will be described with reference to FIGS. 1 through 6. While the sheet processing apparatus of this embodiment is incorporated into a color copying machine, it may also be incorporated into a printing machine, a laser beam printer or the like. The apparatus into which the sheet processing apparatus of this embodiment is to be incorporated is not restricted to a color copying machine.

The sheet processing apparatus 1 is equipped with a processing tray 51 as a stacking portion on which sheets are stacked in a bundle form, an intermediate portion stapler 11 as an intermediate portion stapling means for stapling the sheet bundle stacked on the processing tray 51, a sheet bundle conveying member 50 as a conveying portion for conveying the stapled sheet bundle, a curved sheet bundle conveying path 47 as a curved guide path downwardly curved on the downstream side of the processing tray 51 with respect to the sheet conveying direction and adapted to guide the sheet bundle conveyed by the sheet bundle conveying member 50, a folding device 55 as a folding means adapted to fold the stapled sheet bundle and arranged in an intermediate portion of the curved sheet bundle conveying path 47, etc.

The sheet processing apparatus 1 is adapted to perform a saddle stitch binding processing (saddle stitching) in which sheets supplied from the apparatus main body 31 of the color copying machine 30 are formed into a bundle and are stapled at the center and near the center thereof by the intermediate portion stapler (saddle stitching stapler) 11 before being folded into two to make a booklet, a side stitch binding processing (staple sorting) in which an end portion of the sheet bundle is stapled by an end stapler 10, and an alignment processing (sorting) in which an end portion of the sheet bundle is solely aligned without being stapled. It is also possible for the sheet processing apparatus to be at least capable of performing saddle stitching only. On the downstream side of the curved sheet bundle conveying path 47 with respect to the sheet conveying direction, there is arranged an extended portion 52, which makes it possible to perform processing on large format sheets such as A3 sheets, or perform saddle stitching not at the center and a portion near the center of the sheet bundle but at a position deviated to the upstream side with respect to the sheet conveying direction. The extended portion 52 is provided under the processing tray 51, so that there is no need for an increase in size in the horizontal direction with respect to the sheet conveying direction, which contributes to a reduction in the size of the sheet processing apparatus 1. While in this embodiment the extended portion 52 is a linear conveying path connected to the curved sheet bundle conveying path 47, but it is not absolutely necessary for the extended portion 52 to be linear; it may also be of a curved configuration like the curved sheet bundle conveying path 47, or a part of the curved sheet bundle conveying path 47 may extend as it is to a position under the processing tray 51 as the extended portion.

Figure 7:
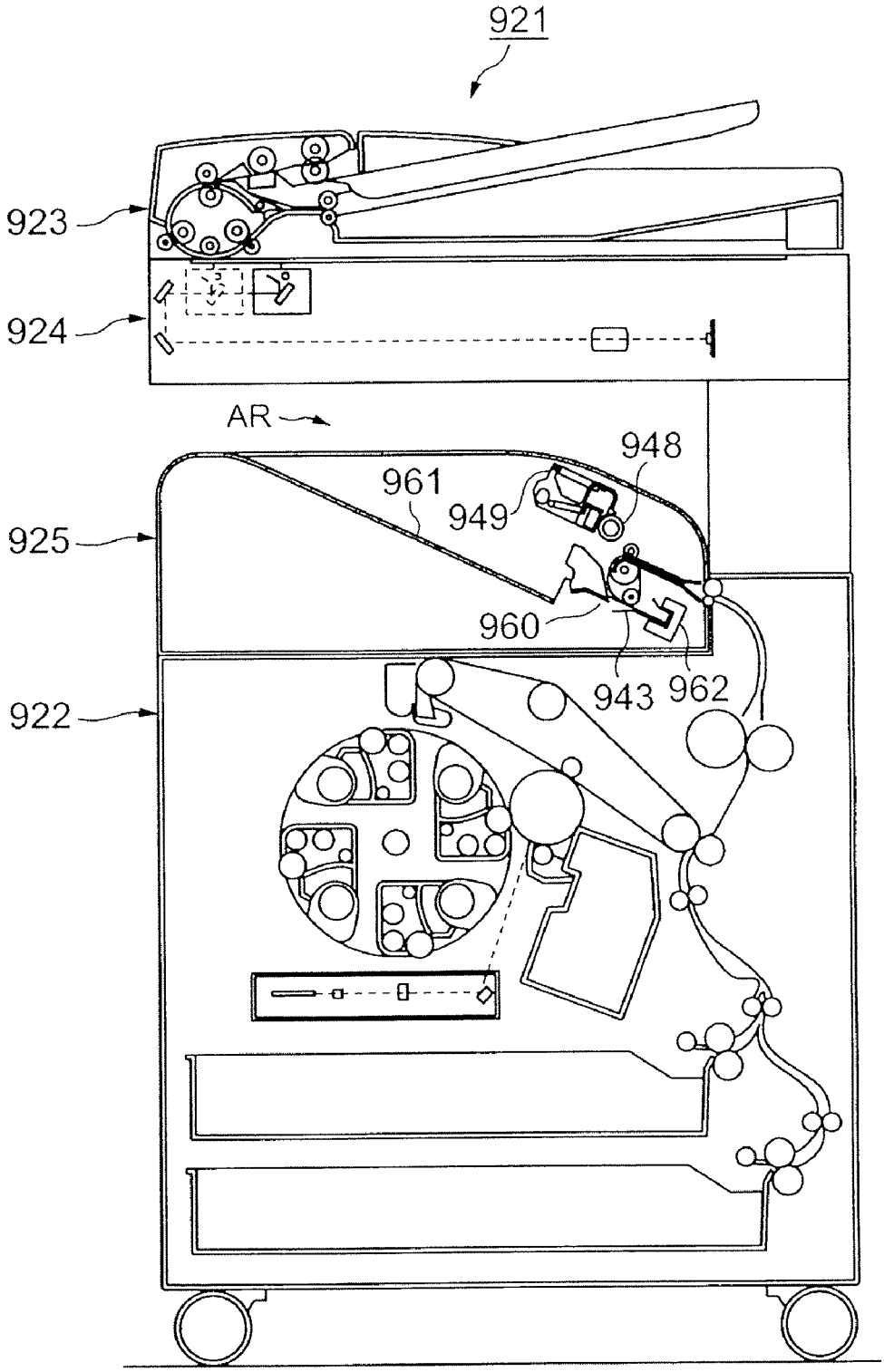
FIG. 7 is a schematic front sectional view of a color copying machine as another conventional image forming apparatus.
Figure 8:
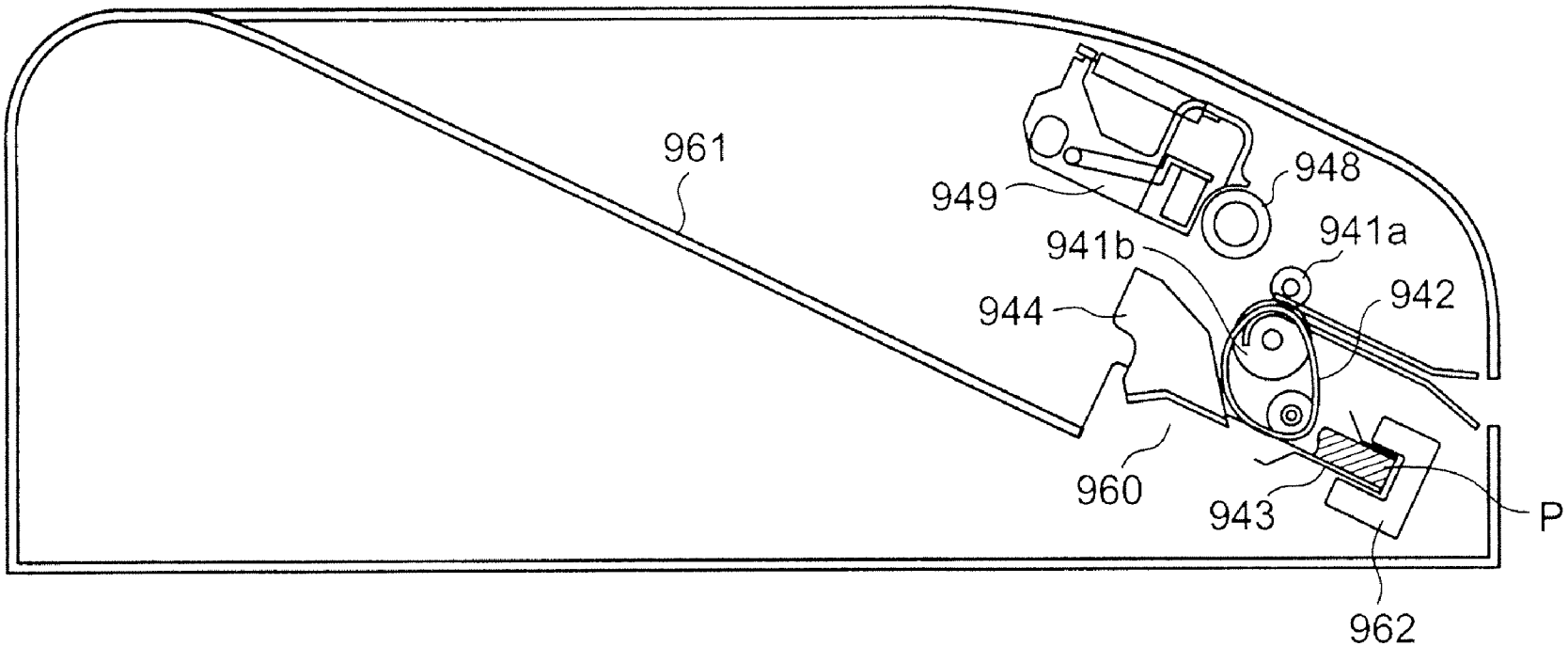
FIG. 8 is a schematic front view of a conventional sheet processing apparatus provided in the color copying machine of FIG. 7.
Figure 9:
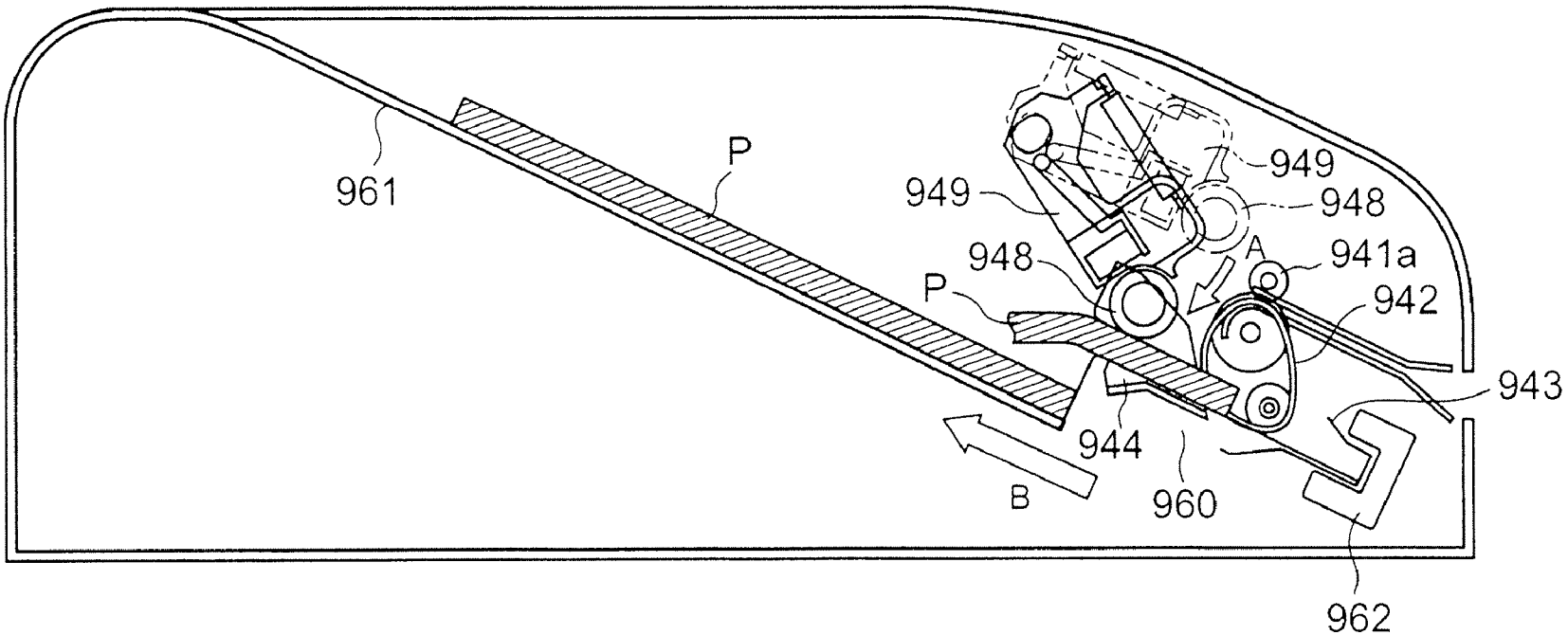
FIG. 9 is a diagram for illustrating a side stitch binding processing (staple sorting) operation by the sheet processing apparatus of FIG. 8.

The sheet processing apparatus 1 of this embodiment is to be realized by endowing the conventional sheet processing apparatus 925 shown in FIGS. 7 through 9, which has a staple sorting function and a sorting function, with a saddle stitching function; the portions performing staple sorting and sorting are substantially the same as those of the conventional sheet processing apparatus.

Further, in the sheet processing apparatus 1 of this embodiment, almost all the components are accommodated in a housing 8, and the sheet processing apparatus 1 is detachably provided in the sheet discharging space AR between the apparatus main body 31 containing the photosensitive drum 3 constituting the image forming portion and the image reading device 36. In this case, the sheet processing apparatus 1 can be detached from the apparatus main body 31 for easy maintenance.

(Operation of the Sheet Processing Apparatus)

(Illustration of the Saddle Stitching Operation)

Saddle stitching will be illustrated with reference to FIGS. 2 through 5. By way of example, a case will be illustrated in which saddle stitching is performed on an A3 size sheet.

Figure 2:
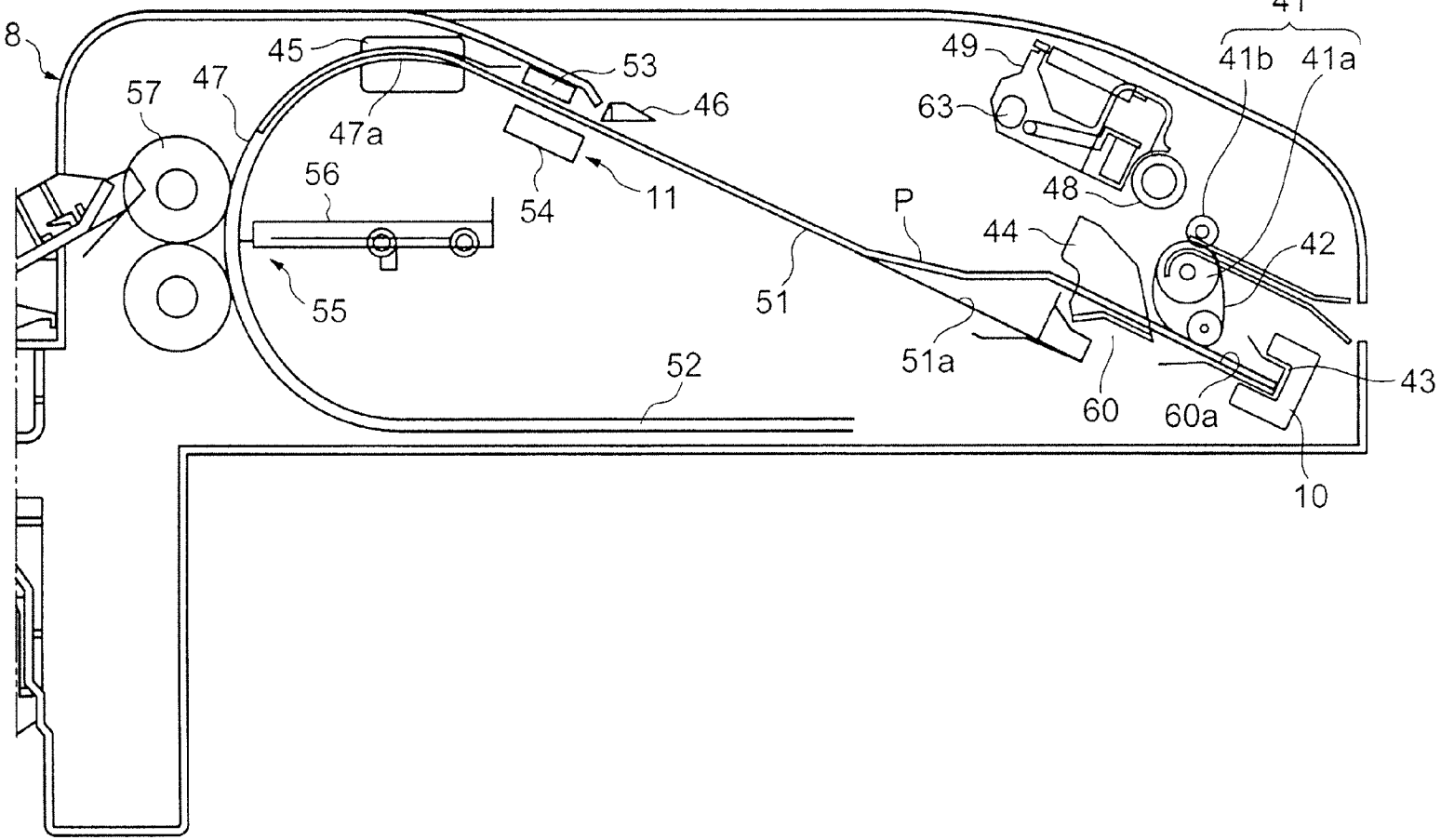
FIG. 2 is a schematic front view of a sheet processing apparatus according to an embodiment of the present invention provided in the color copying machine of FIG. 1.

When a saddle stitching mode is selected, a conveying path switching member 46 is tilted from the position shown in FIG. 1 to that shown in FIG. 2 so that a sheet can be guided into the curved conveying path 47, and is separated from the processing tray 51. The conveying path switching member 46 as a guide member is tilted by a plunger (not shown), selectively guiding sheets to the interior and exterior of the curved conveying path 47. The sheets needing no saddle stitching is guided to the exterior of the curved conveying path 47 by the conveying path switching member 46, and undergoes end stapling as needed before being stacked on the processing tray 51.

The sheet P discharged from the apparatus main body 31 of the color copying machine 30 is transferred to a discharging roller pair 41, by means of which the sheet P is discharged into the sheet processing apparatus 1. The discharging roller pair 41 is composed of a driving roller 41*a* and a driven roller 41*b*. A return belt 42 is nipped between the rollers 41*a* and 41*b*. Thus, when the discharging roller pair 41 rotates so as to discharge the sheet into the sheet processing apparatus 1, the return belt 42 is driven to run counterclockwise in FIG. 2.

The sheets discharged into the sheet processing apparatus 1 by the discharging roller pair 41 are stacked so as to extend over both processing trays 60 and 51. At this time, the end portions of the sheets on the downstream side with respect to the sheet conveying direction are in the curved conveying path 47. In each of the sheet stacking surface 60*a* of the processing tray 60 and the sheet stacking surface 51*a* of the processing tray 51, the portion on the upstream side is set to be lower than the portion on the downstream side with respect to the sheet conveying direction. That is, in FIG. 2, the sheet stacking surfaces 60*a* and 51*a* are formed so as to slope down toward the upstream side with respect to the sheet conveying direction.

The upstream side end portions (the right-hand side end in FIG. 2) with respect to the sheet conveying direction of the sheets stacked so as to extend over both the sheet stacking surfaces 60*a* and 51*a* are caused to abut a trailing end stopper 43 through the rotation of the return belt 42. Further, the sheet side portions extending along the sheet conveying direction are aligned by a pair of aligning plates 44 and 45 arranged at two positions on the upstream side and the downstream side with respect to the sheet conveying direction. That is, width alignment is effected on the sheets. It is not always necessary to perform width alignment at this point in time.

Figure 3:
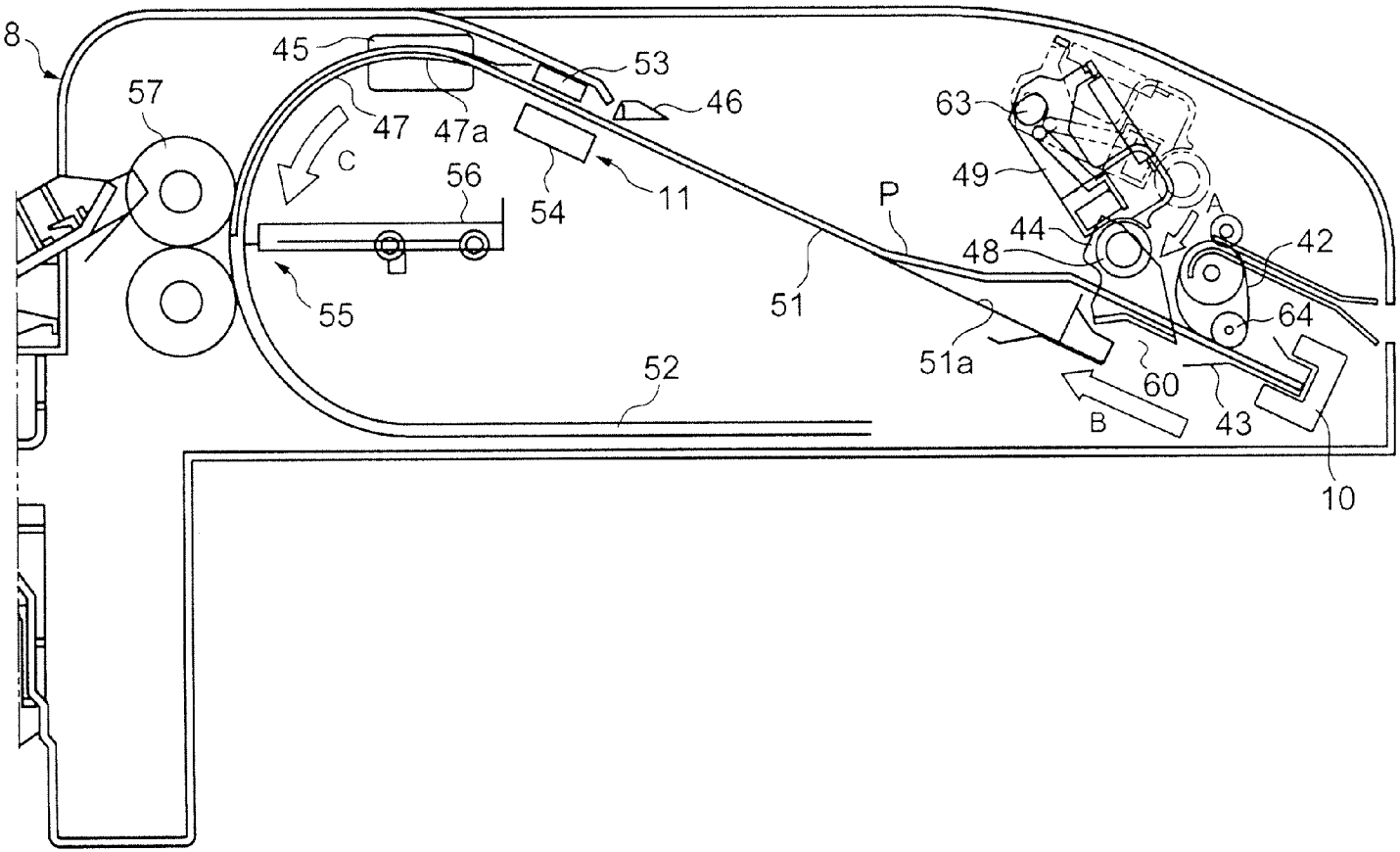
FIG. 3 is a diagram for illustrating a saddle stitch binding processing (saddle stitching) operation by the sheet processing apparatus of FIG. 2.

Next, as shown in FIG. 3, a swinging arm 49 swingable around a rotation shaft 63 is rotated in the direction indicated by an arrow A by a plunger (not shown). Then, a swinging roller 48 provided on the swinging arm 49 comes into contact with the sheets, and conveys the sheets in the direction indicated by an arrow B. At this time, the return belt 42 is away from the sheet bundle due to an upward movement of a return roller 64. The upstream side end portions of the sheets with respect to the sheet conveying direction leave the sheet stacking surface 60*a*, and the sheets are stacked on the inclined sheet stacking surface 51*a* of the processing tray 51. Thereafter, the upstream side end portions of the sheets with respect to the sheet conveying direction easily move toward the sheet bundle conveying member 50 due to the inclination of the sheet stacking surface 51*a*, and are received by the sheet bundle conveying member 50 as an end aligning portion. As a result, the upstream side end portions of the sheets with respect to the sheet conveying direction are aligned reliably. The swinging arm 49 returns to the initial position indicated by the chain double-dashed line in FIG. 3 to make itself ready for the next sheet discharge. Besides receiving the trailing ends of the sheets to perform end alignment, the sheet bundle conveying member 50 serves, as described below, to push the trailing end of the stapled sheet bundle to convey the sheet bundle to the folding device 55.

Figure 4:
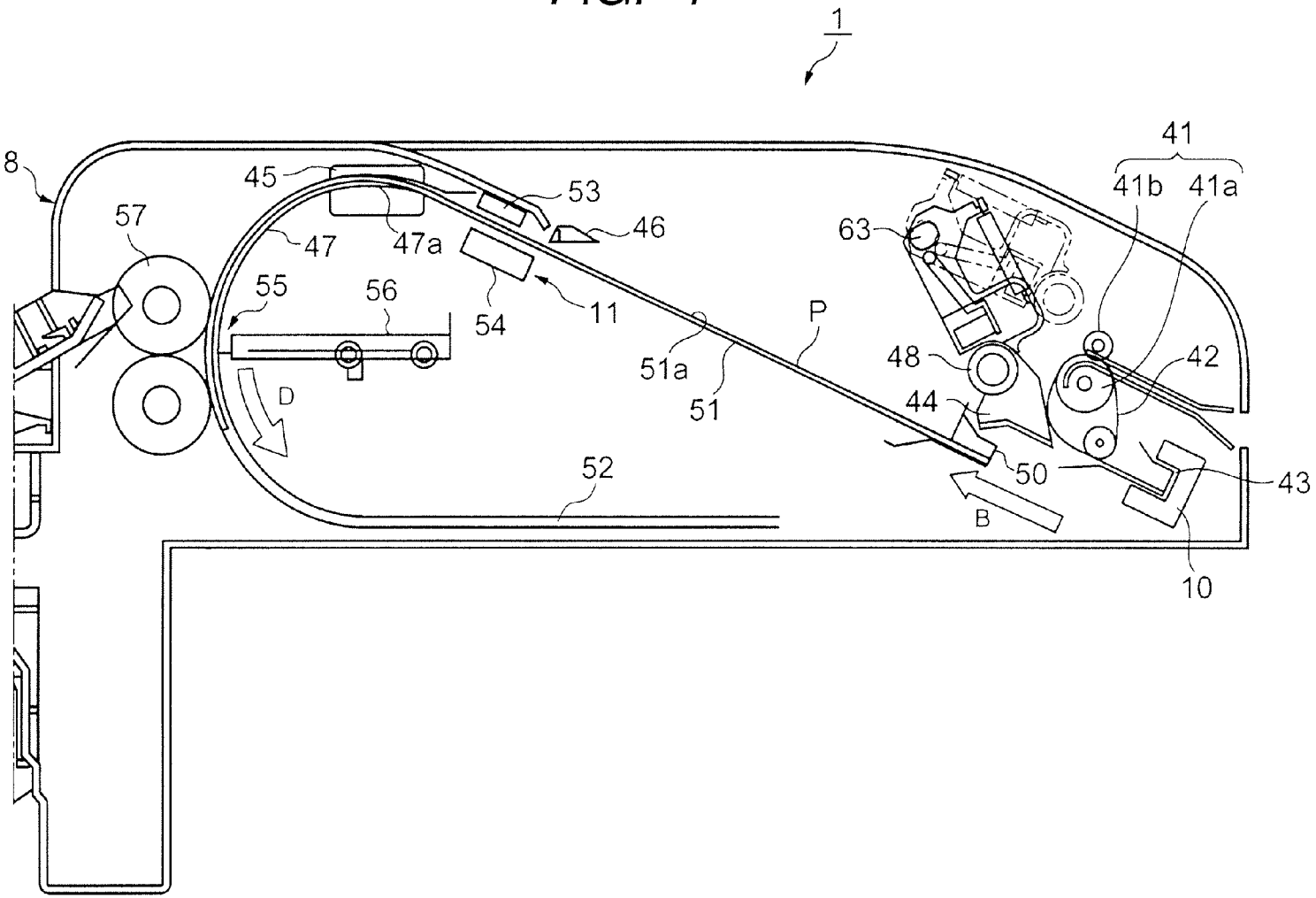
FIG. 4 is a diagram for illustrating the saddle stitch binding processing as continued from FIG. 3.

Since in this example A3 size sheets are used, the downstream side end portions of the sheets with respect to the sheet conveying direction advance in the direction indicated by the arrow C in FIG. 3 through the curved sheet bundle conveying path 47 and further advance in the direction indicated by the arrow D in FIG. 4 meeting with a certain degree of resistance. Thus, depending upon the coefficient of friction of the sheets, there is a fear of the abutment of the sheets against the sheet bundle conveying member 50, which utilizes the inclination of the sheet stacking surface 51*a*, becoming unreliable. In such cases, it is possible to provide a return roller pair or the like along the sheet stacking surface 51*a*, thereby aiding the abutment of the sheets against the sheet bundle conveying member 50.

The sheet processing apparatus 1 repeats the operation as shown in FIGS. 2 through 4 a desired number of times to stack a plurality of sheets on the processing tray 51. Thereafter, final width alignment is effected by an aligning plate 45. Then, stapling is effected on the sheet bundle by an intermediate portion stapler 11 composed of an anvil 53 and a driver 54. The intermediate portion stapler 11 staples sheet portions stacked on the flat sheet stacking surface 51*a*, so that it is possible to accurately staple a predetermined portion of the sheet bundle.

Positioning is effected on the upstream side end portion of the sheet bundle with respect to the sheet conveying direction by the sheet bundle conveying member 50, so that, depending on the sheet size, the stapling position of the sheet bundle does not necessarily coincides with the intermediate portion stapler 11. In such cases, the sheet bundle conveying member 50 is moved along the sheet conveying direction to cause the stapling position of the sheet bundle to coincide with the intermediate portion stapler 11, or the intermediate portion stapler 11 is moved to the stapling position of the sheet bundle before stapling the intermediate portion of the sheet bundle. While in many cases, the position of the intermediate portion to be stapled of the sheet bundle is actually the center of the sheet bundle with respect to the sheet length direction, the position is not restricted to the center. When the size of the sheets to be subjected to saddle stitching differs from the pre-set sheet size, or when the stapling position of the sheet bundle is not the center thereof, positioning at the processing position is effected, with the end portion of the sheet bundle with respect to the sheet conveying direction being deviated to the processing tray 51 side or to the extended portion 52 side. However, the path length is set with margin in the sheet conveying direction from the processing tray 51 to the extended portion 52, so that it does not matter which way the deviation occurs. With this path length, the processing tray 51 and the extended portion 52 are arranged so as to vertically overlap each other, with the curved sheet bundle conveying path 47 serving as a turning portion, so that there is involved no increase in the dimension in the height direction and the dimension in the horizontal direction with respect to the sheet conveying direction, of the sheet processing apparatus 1.

Figure 5:
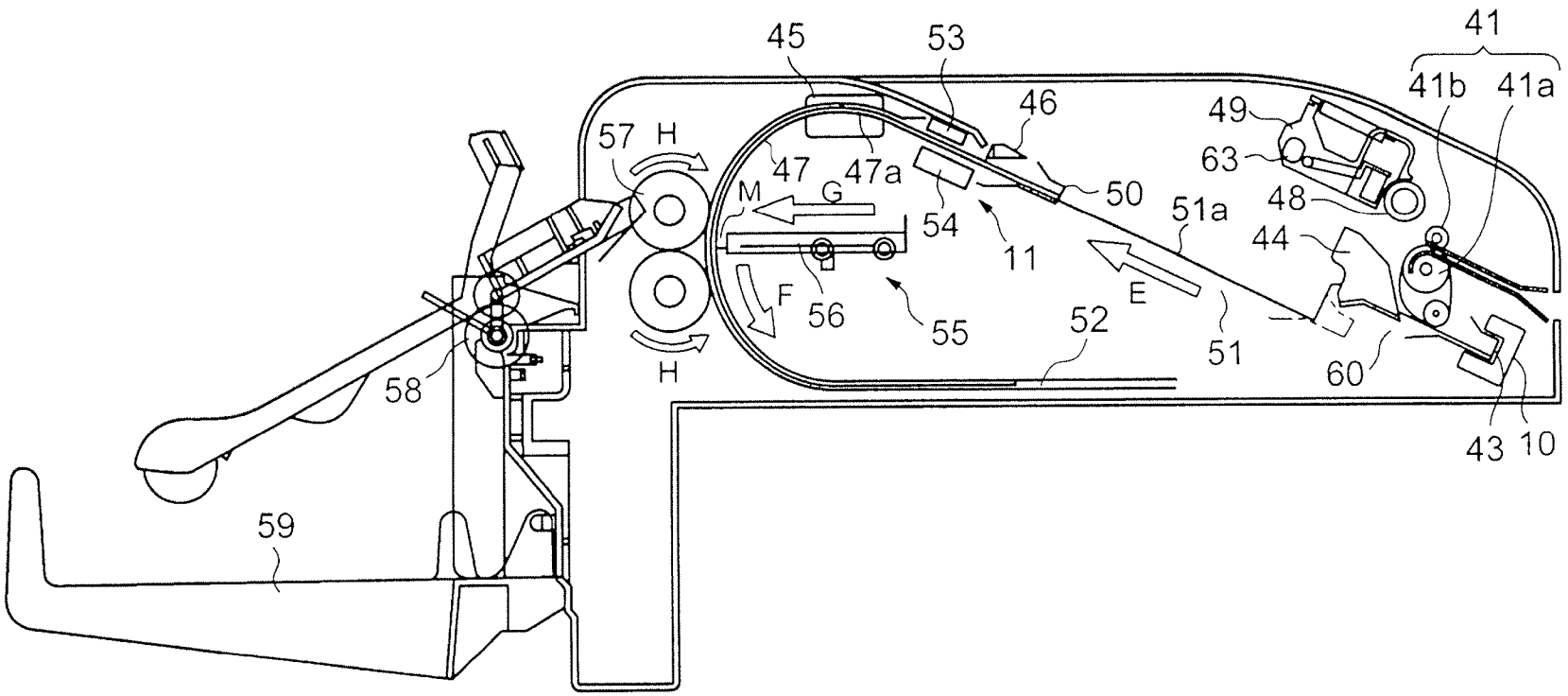
FIG. 5 is a diagram for illustrating the saddle stitch binding processing as continued from FIG. 4.

As shown in FIG. 5, the stapled sheet bundle is conveyed in the direction indicated by the arrow E by the sheet bundle conveying member 50. The leading end of the sheet bundle further advances in the direction indicated by the arrow F within the curved sheet bundle conveying path 47. When the stapled portion M of the sheet bundle moves to a position where it faces a thrusting plate 56 of the folding device 55 and the nip of a folding roller pair 57, the sheet bundle conveying member 50 stops the conveyance of the sheet bundle. The folding device 55 is arranged inside the curve of the downwardly curved sheet bundle conveying path 47. An upstream side portion 47*a* with respect to the sheet conveying direction of the curved sheet bundle conveying path 47 is at the uppermost position of the processing tray 51 and the curved sheet bundle conveying path 47.

The thrusting plate 55 moves in the direction indicated by the arrow G in FIG. 5, and thrusts the stapled portion M of the sheet bundle. The sheet bundle is pushed into the nip of the folding roller pair 57 having started to rotate in the directions indicated by the arrows H while being folded by the thrusting plate 55. The folding roller pair 57 folds and conveys the sheet bundle while rotating in the directions indicated by the arrows H in FIG. 5, and transfers the sheet bundle to a discharging roller pair 58. Finally, the discharging roller pair 58 discharges the sheet bundle onto a discharge tray 59. In this way, the sheets having undergone image formation in the apparatus main body 31 of the color copying machine 30 are formed into a bundle, stapled at the intermediate portion thereof, and, finally, stacked on the discharge tray 59 as a booklet.

As described above, in the sheet processing apparatus 1 of the present invention, the intermediate portion stapler 11 and the folding device 55 are arranged in a place which is in a region between the processing tray 51 and the extended portion 52 and, at the same time, in a vertical region of the downwardly curved sheet bundle conveying path 47, and the thrusting plate 56 is arranged on the inner side of the curve of the curved sheet bundle conveying path 47, thus effectively utilizing the available space, whereby it is possible to provide a saddle stitching function without involving an increase in the size of the apparatus as a whole.

(Description of Staple Sorting Operation and Sorting Operation)

When a staple sorting mode is selected, the conveying path switching member 46 is brought into contact with the processing tray 51 as shown in FIG. 1 so that the sheets may be guided to the exterior of the curved conveying path 47. The sheets P discharged from the apparatus main body 31 of the color copying machine 30 are transported to the discharging roller pair 41, by means of which they are discharged into the sheet processing apparatus 1.

The sheets discharged into the sheet processing apparatus 1 by the discharging roller pair 41 are stacked so as to extend over both the processing trays 60 and 51. The sheets stacked on the sheet stacking surfaces 60*a* and 51*a* are caused to abut the trailing end stopper 43 through the rotation of the return belt 42 for trailing end alignment before undergoing width alignment by a pair of aligning plates 44.

The sheets stacked in a predetermined number on the sheet stacking surfaces 60*a* and 51*a* and formed into a bundle are stapled by the trailing end stapler 10 as an end stapling means, and are discharged and are dropped onto the sheet stacking surface 51*a* through rotation of the lowered swinging roller 48. Thus, the sheet bundle that has undergone staple sorting can be extracted from the processing tray 51.

Sorting only differs from staple sorting in that no stapling operation is performed; otherwise, they are the same, so a description of the sorting operation will be omitted.

The sheet processing apparatus 1 of this embodiment, described above, is based on the conventional sheet processing apparatus 925 shown in FIG. 7 equipped with a processing tray whose sheet stacking surface is set to be lower on the upstream side than on the downstream side with respect to the sheet conveying direction, and an end stapler; in the sheet processing apparatus of this embodiment, the intermediate portion stapler 11 and the folding device 55 are arranged above the upstream side portion of the processing tray with respect to the sheet conveying direction such that the sheets stacked on the processing tray 51 are stapled by the intermediate portion stapler 11 for stapling the intermediate portion of a sheet bundle, and then folded by the folding device 55 in the intermediate portion of the curved sheet bundle conveying path 47 downwardly curved on the downstream side of the processing tray 51 with respect to the sheet conveying direction.

Figure 6:
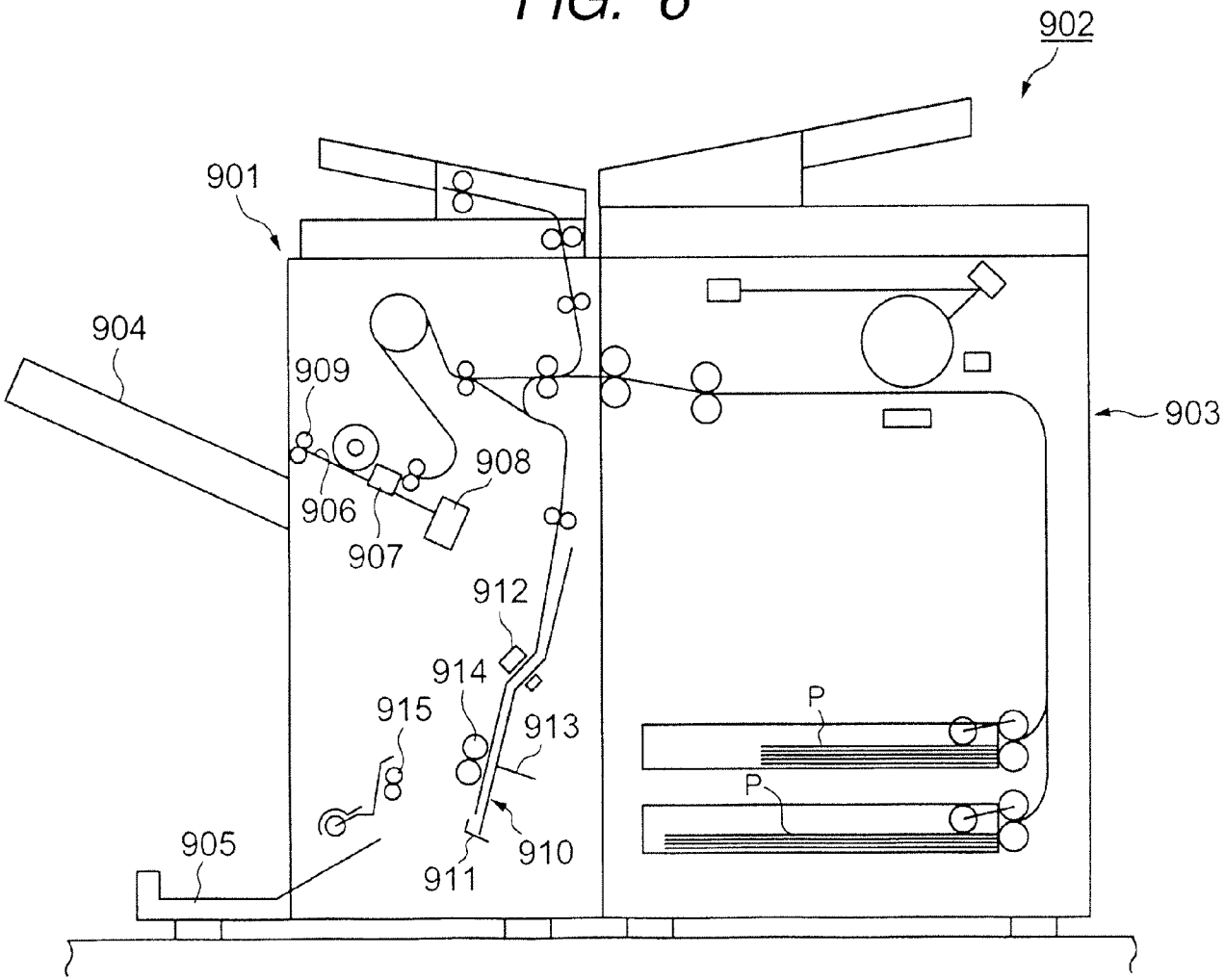
FIG. 6 is a schematic front sectional view of a color copying machine as a conventional image forming apparatus.

Thus, despite the fact that it is endowed with a saddle stitch binding function in addition to the side stitch binding function, the sheet processing apparatus 1 of this embodiment allows a reduction in the length in the sheet conveying direction as compared with the conventional sheet processing apparatus 901 shown in FIG. 6, and can be of a size equivalent to that of the sheet processing apparatus 925 shown in FIG. 7.

Further, due to the fact that the sheet stacking surface 51*a* of the processing tray 51 is set to be lower on the upstream side than on the downstream side, the processing tray 51 is inclined compared to the horizontal position, with the result that the length of the sheet stacking surface 51*a* in the sheet conveying direction is much larger, thereby making the sheet processing apparatus also applicable to large format sheets. Further, it is possible to install the end stapler 10 for stapling the end portion of a sheet bundle on the upstream side of the processing tray 51, thereby improving the function.

Further, in the sheet processing apparatus 1 of this embodiment, the processing tray 51 and the extended portion 52 are arranged so as to vertically overlap each other, with the curved sheet bundle conveying path 47 serving as the turning portion, whereby it is possible to reduce the length in the height direction in the sheet conveying direction of the sheet processing apparatus 1 as compared with the conventional sheet processing apparatus 901 (shown in FIG. 6) and to form the sheet processing apparatus 1 in a size equivalent to that of the conventional sheet processing apparatus 925 (shown in FIG. 7), so that it is possible to provide the sheet processing apparatus 1 in the sheet discharging space AR between the apparatus main body 31 containing the photosensitive drum 3 and the image reading device 36.

Further, in the sheet processing apparatus 1 of this embodiment, the constructions of the portions related to the staple sorting and sorting functions are substantially the same as those of the portions related to the staple sorting and sorting functions of the conventional sheet processing apparatus 925 shown in FIG. 7, and, further, there is provided the conveying path switching member 46 for effecting switching so as to guide the sheet bundle that has undergone staple sorting or sorting to the exterior of the curved sheet bundle conveying path 47, whereby the sheet bundle, that has undergone staple sorting or sorting, can be extracted by the same operation as in the conventional art.

Thus, even when a color copying machine equipped with the sheet processing apparatus of this embodiment coexists with a color copying machine equipped with a conventional sheet processing apparatus, the user can, at the time of staple sorting or sorting by the sheet processing apparatus 1, extract the sheet bundle by the same action without making distinction between the color copying machines.

This application claims priority from Japanese Patent Application Nos. 2004-211806 filed Jul. 20, 2004 and 2005-193037 filed Jun. 30, 2005 which are hereby incorporated by reference herein.

What is claimed is:

1. An image forming apparatus comprising:

an image forming portion which forms an image on a sheet; and a sheet processing apparatus which is provided above the image forming portion and which performs a processing on the sheet on which the image has been formed by the image forming portion, the sheet processing apparatus comprising:

a stacking portion on which sheets are stacked;

a conveying portion which conveys a sheet or a sheet bundle stacked on the stacking portion;

a curved guide path which is arranged downstream of the stacking portion in a sheet conveying direction and which guides the sheet or the sheet bundle conveyed by the conveying portion while curving the sheet or the sheet bundle downward; and a folding device which is arranged on the curved guide path and which folds the sheet or the sheet bundle, wherein a sheet stacking surface of the stacking portion is set to be higher on a downstream side than on an upstream side in the sheet conveying direction, and wherein the curved guide path connects to an extended portion, arranged downstream of the curved guide path, which extends between the stacking portion and the image forming portion.

2. An image forming apparatus according to claim 1, wherein the folding device is provided with a thrusting member which thrusts the sheet or the sheet bundle from an inner side toward an outer side of the curved guide path and a folding portion which receives and folds the sheet or the sheet bundle thrust by the thrusting member.

3. An image forming apparatus according to claim 2, wherein the sheet processing apparatus further comprises a saddle stitching stapler which staples an intermediate portion of the sheets stacked on the stacking portion, and wherein the folding device folds a stapled portion of the sheet bundle stapled by the saddle stitching stapler.

4. An image forming apparatus according to claim 1, wherein the sheet processing apparatus further comprises a guide member which selectively guides the sheets to an interior and an exterior of the curved guide path.

5. An image forming apparatus according to claim 1, wherein the extended portion is a linear conveying path.

6. An image forming apparatus according to claim 1, further comprising an end stapler which staples an end portion in the conveying direction of the sheets, wherein the end stapler is arranged on the upstream side of the stacking portion.

7. An image forming apparatus comprising:

a reading device which reads a record of a recording material;

an image forming portion which is arranged below the reading device and which forms an image on a sheet based on reading information of the reading device; and a sheet processing apparatus which is arranged between the reading device and the image forming portion and which performs a processing on the sheet on which the image has been formed, the sheet processing apparatus comprising:

a stacking portion on which sheets are stacked;

a conveying portion which conveys a sheet or a sheet bundle stacked on the stacking portion;

a curved guide path which is arranged downstream of the stacking portion in a sheet conveying direction and which guides the sheet or the sheet bundle conveyed by the conveying portion while curving the sheet or the sheet bundle downward; and a folding device which is arranged in the curved guide path and which folds the sheet or the sheet bundle, wherein a sheet stacking surface of the stacking portion is set to be higher on a downstream side than on an upstream side in the sheet conveying direction, and wherein the curved guide path connects to an extended portion, arranged downstream of the curved guide path, which extends between the stacking portion and the image forming portion.

8. An image forming apparatus according to claim 7, wherein the sheet processing apparatus is detachably mountable between the reading device and the image forming portion.

9. An image forming apparatus according to claim 7, wherein the folding device is provided with a thrusting member which thrusts the sheet or the sheet bundle from an inner side toward an outer side of the curved guide path and a folding portion which receives and folds the sheet or the sheet bundle thrust by the thrusting member.

10. An image forming apparatus according to claim 9, wherein the sheet processing apparatus further comprises a saddle stitching stapler which staples an intermediate portion of the sheets stacked on the stacking portion, and wherein the folding device folds a stapled portion of the sheet bundle stapled by the saddle stitching stapler.

11. An image forming apparatus according to claim 7, wherein the sheet processing apparatus further comprises a guide member, which selectively guides the sheets to an interior and an exterior of the curved guide path.

12. An image forming apparatus according to claim 7, wherein the extended portion is a linear conveying path.

13. An image forming apparatus according to claim 7, further comprising an end stapler which staples an end portion in the conveying direction of the sheets, wherein the end stapler is arranged on the upstream side of the stacking portion.

* * * * *

UNITED STATES PATENT AND TRADEMARK OFFICE

CERTIFICATE OF CORRECTION

PATENT NO. : 7,410,156 B2
APPLICATION NO. : 11/688266
DATED : August 12, 2008
INVENTOR(S) : Ikeda et al.

It is certified that error appears in the above-identified patent and that said Letters Patent is hereby corrected as shown below:

ON THE TITLE PAGE:
At Item (62), Related U.S. Application Data, "filed on Jul. 14, 2005." should read --filed on Jul. 14, 2005, now U.S. Patent No. 7,288,059.--.

COLUMN 6:
Line 60, "sheets" should read --sheet--.

COLUMN 8:
Line 18, "coincides" should read --coincide--.

Signed and Sealed this

Sixteenth Day of December, 2008

JON W. DUDAS
*Director of the United States Patent and Trademark Office*